US005800664A

United States Patent [19]

Covert

[11] Patent Number: 5,800,664

[45] Date of Patent: Sep. 1, 1998

[54] CARPET SEAMING APPARATUS AND METHOD OF UTILIZING THE SAME

[76] Inventor: William H. Covert, P.O. Box 668, Saucier, Mich. 39574

[21] Appl. No.: 582,397

[22] Filed: Jan. 3, 1996

[51] Int. Cl.[6] ..... A47G 27/04; B29C 65/00

[52] U.S. Cl. ..... 156/304.4; 156/304.6; 156/304.7; 16/16

[58] Field of Search ..... 156/304.4, 304.7, 156/304.6; 16/16

[56] References Cited

U.S. PATENT DOCUMENTS

| | | | |
|---|---|---|---|
| 2,552,114 | 5/1951 | Reinhard . | |
| 3,413,678 | 12/1968 | Krantz . | |
| 3,760,454 | 9/1973 | Heinzel et al. . | |
| 4,416,713 | 11/1983 | Brooks | 156/304.4 X |
| 5,104,475 | 4/1992 | Foster et al. . | |

FOREIGN PATENT DOCUMENTS

| | | | |
|---|---|---|---|
| 9119445 | 12/1991 | WIPO | 16/4 |

*Primary Examiner*—Michael W. Ball
*Assistant Examiner*—Sam Chuan Yao
*Attorney, Agent, or Firm*—Everett G. Diederiks, Jr.

[57] ABSTRACT

A carpet seaming apparatus is formed from an elongated plate that is inextendible in both longitudinal and lateral directions. The plate has a substantially smooth lower surface which enables the plate to readily slide upon a supporting surface. An upper surface of the plate is divided into multiple, transversely spaced and longitudinally extending zones. In the preferred embodiment, three such zones, including two edge zones spaced by a central zone, are provided. Numerous upstanding sharp projections are provided in each of the edge zones and an adhesive layer is provided in the central zone. A peelable protective cover is arranged atop the adhesive layer. With respective edge portions of two carpet sections secured to the plate through the projections and the adhesive, the carpet sections can be readily power stretched with the plate being free to slide relative to the supporting surface upon which the carpet is arranged.

18 Claims, 1 Drawing Sheet

CARPET SEAMING APPARATUS AND METHOD OF UTILIZING THE SAME

BACKGROUND OF THE INVENTION

1. Field of the Invention

The present invention pertains to the art of carpets and, more particularly, to an apparatus for use in seaming carpet sections while enabling the sections to be simultaneously stretched, as well as a method of utilizing the carpet seaming apparatus.

2. Discussion of the Prior Art

When installing wall-to-wall carpeting, it is common practice to join various carpet sections by seaming abutting edge strips of the carpet sections. There has heretofore been utilized numerous types of seaming arrangements. These known seaming arrangements include sewing the abutting edge strips, adhesively joining the carpet sections through the use of a heat tape and interconnecting the carpet sections through cleated connectors. In each case, the interconnection of the carpet sections is preformed manually by the installer.

Creating a seam by sewing carpet sections together can be extremely time consuming and can add considerable costs to the installation of the carpet. For these reasons alone, this seaming method is being utilized with less frequency in today's market. Utilizing heat tape in creating carpet seams, on the other hand, is extremely commonplace as it reduces required installation time and is quite cost effective. Unfortunately, drawbacks exist with respect to this seaming method as well. Although the need for additional tools such as a hot iron may be considered a drawback with such a seaming arrangement, the main drawback concerns the fact that it is extremely common for such a carpet seam to fail well before the carpet wears out. This fact is particularly prevalent in seamed wall-to-wall carpet installations where the entire carpet is stretched utilizing a power stretcher since stretching the carpet in this manner subjects the seam to rather large tension forces. In addition, based on the amount of adhesive utilized, high spots can be formed in the carpeted area and the minimization of such spots depends on the expertise of the installer. The concept of utilizing cleated connectors in creating carpet seams has been long before proposed as evidenced by the teachings in U.S. Pat. Nos. 2,552,114, 3,413,678 and 3,760,454. Unfortunately, each of these known arrangements have their associated drawbacks and have therefore not experienced much commercial success. In particular, these cleated connector arrangements are either not designed for use or simply not effective when utilized in power stretched wall-to-wall carpet installations due to their particular structure which enable them to stretch or flex in one or more directions, as well as the manner in which they are mounted to the carpet sections and supporting surfaces.

In any event, there exists a need in the art for a carpet seaming apparatus that can be efficiently and effectively utilized to install seamed carpets, particularly in power stretched wall-to-wall carpet installations. More particularly, there exists a need in the art for an arrangement that can be used to readily produce carpet seams which are strong, tight, consistently even and which have reduced seam tension associated therewith so as to provide for a long lasting, reliable seam.

SUMMARY OF THE INVENTION

The carpet seaming apparatus of the present invention is formed from an elongated plate that is inextendible in both longitudinal and lateral directions. In the preferred embodiment, a thin metal plate having is utilized, however, the plate could be formed from rigid plastic. The plate has a substantially smooth lower surface which enables the plate to readily slide upon a supporting surface. An upper surface of the plate is divided into multiple, transversely spaced and longitudinally extending zones. In the preferred embodiment, three such zones, including two edge zones spaced by a central zone, are provided. Numerous upstanding sharp projections are provided in each of the edge zones and a double-sided adhesive tape is provided in the central zone. A peelable protective cover is arranged atop the adhesive tape.

In use, the plate is cut in length to correspond to the width dimension of the carpet sections to be seamed. With an end of one of the carpet sections attached to a supporting surface at one wall in the area to be carpeted such as through the use of a conventional tack-down strip, terminal edge portions of the carpet sections to be seamed are attached to the plate through the projections and the adhesive tape. Thereafter, the seamed carpet sections can be simultaneously stretched, such as through the use of a power stretcher, to conform the seamed carpet to the application area. Stretching of the carpet sections will cause sliding of the plate relative to the supporting surface. Since the plate is inextendible in both lateral and longitudinal directions thereof and due to the interconnection between the plate and each of the carpet sections, the seam will remain intact throughout the stretching operation.

Additional features and advantages of the carpet seaming apparatus of the present invention will become more readily apparent from the following detailed description of the preferred embodiment thereof, when taken in conjunction with the drawings wherein like reference numerals refer to corresponding parts in the several views.

DETAILED DESCRIPTION OF THE PREFERRED EMBODIMENT

Figure 1:
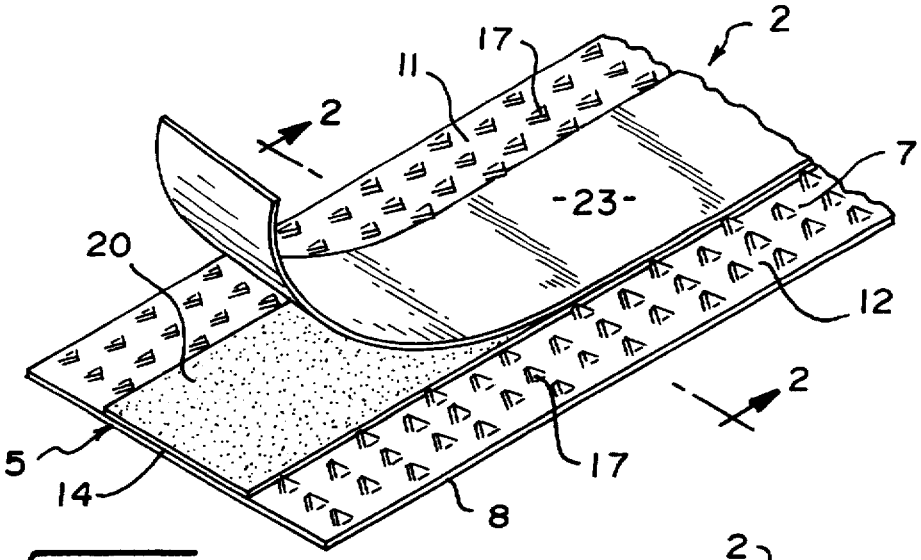
FIG. 1 is a perspective view of a predetermined length of the carpet seaming apparatus of the invention.
Figure 2:
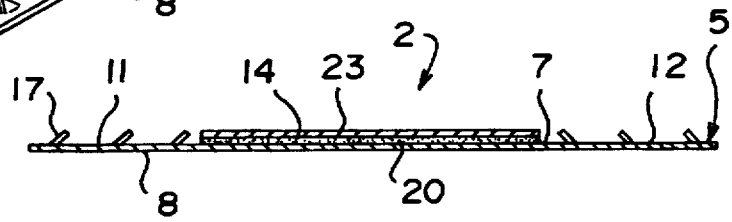
FIG. 2 is a cross-sectional view generally taken along line 2—2 in FIG. 1.

With initial reference to FIGS. 1 and 2, the carpet seaming apparatus of the present invention is generally indicated at 2. Carpet seaming apparatus 2 comprises an elongated plate 5 having an upper surface 7 and a lower surface 8. Plate 5 is preferably formed from metal so as to be inextendible in both longitudinal and transverse directions thereof. In the preferred embodiment, plate 5 is formed from 26 gauge galvanized sheet metal, however, it is to be understood that other inextendible materials, including a rigid plastic material, could be utilized to form plate 5. The importance of the inextensibility of plate 5 will become more fully apparent below.

Upper surface 7 of plate 5 is divided into multiple, longitudinally extending zones. In the preferred embodiment depicted, three such zones are provided. These three zones include a first edge zone 11, a second edge zone 12 and a central zone 14, each of which generally define strips that run the full length of plate 5. In the preferred embodiment, first and second edge zones 11 and 12 have widths of approximately one inch and central zone 14 has an associated two inch width. Of course, these specific dimensions can vary in accordance with the invention.

Each of the first and second edge zones 11 and 12 are provided throughout their respective lengths with a plurality of sharp, upstanding projections 17. Projections 17 are preferably stamped or otherwise formed from the material that makes up plate 5. As shown in these Figures, the projections 17 are arranged in rows, with the projections 17 in successive rows being relatively, longitudinally offset. In addition, as clearly shown in FIG. 2, projections 17 are angled toward central zone 14.

Positioned atop upper surface 7 of plate 5, within central zone 14, is a strip of double-sided adhesive tape 20 that is air activated. When not being used, undesirable engagement with the adhesive of tape 20 is prevented due to the presence of a peelable protective cover 23. Although the preferred embodiment utilizes double-sided adhesive tape 20, it should be readily understood that other types of arrangements could be utilized to provide a layer of adhesive in central zone 14. For example, central zone 14 could be coated with a heat activated glue in place of tape 20 without departing from the invention.

Figure 3:
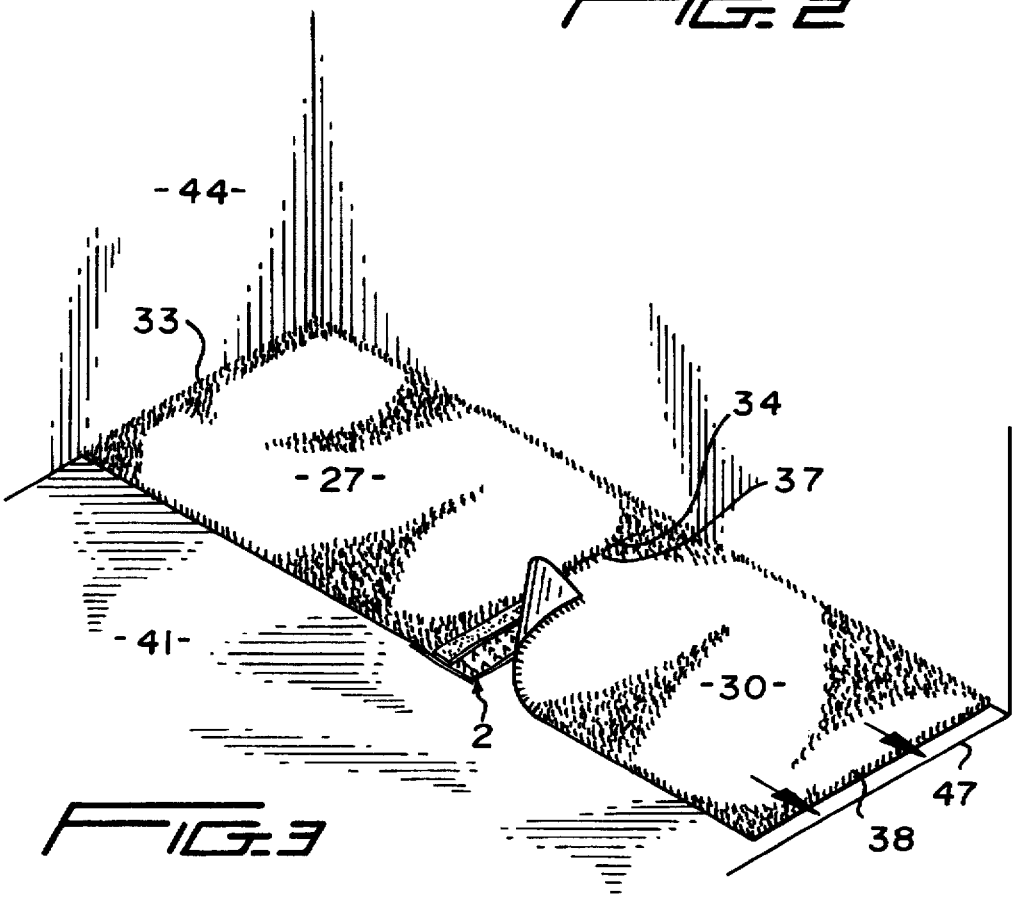
FIG. 3 is a perspective view of an area to be carpeted and indicates the carpet seaming apparatus of the invention in use.

With specific reference to FIG. 3, the carpet seaming apparatus 2 of the invention is shown for use in seaming a first carpet section 27 to a second carpet section 30. As illustrated, first carpet section 27 includes a first edge portion 33 and a second edge portion 34. Likewise, second carpet section 30 includes a first edge portion 37 and a second edge portion 38. With this brief description of the elements depicted in these figures, the preferred method of utilizing device 2 to seam a wall-to-wall carpet and then complete the installation of the carpet will now be described.

In use, plate 5 is cut in length to correspond to the width dimension of the carpet sections 27 and 30 to be seamed. After edge portion 33 of carpet section 27 is attached to a supporting surface 41 at the base of one wall 44 in a known manner, terminal edge portions 34 and 37 of carpet sections 27 and 30 to be seamed are laid in a juxtaposed relationship with the elongated plate 5 thereunder. The second edge portion 34 of first carpet section 27 can then be set into the projections 17 in first edge zone 11 of plate 5 and pushed down into adhesive tape 20, at least after the protective cover 23 is removed. The first edge portion 37 of carpet section 30 can then be similarly attached to plate 5 with the two carpet sections 27 and 30 abutting one another. At this point, the abutting edges, with the factory edges previously removed, can be placed in position for seaming or the seaming can be performed at the completion of the installation such as through the use of a conventional knee-kicker.

Once the carpet sections are interconnected through plate 5 in the manner set forth above, the carpet sections 27 and 30 can be simultaneously stretched with a power stretcher so that the carpet as a whole can reach second wall 47 and fixed at the base thereof, again in a manner which does not form part of the present invention and is widely known so that it will not be discussed herein. Stretching of carpet sections 27 and 30 will cause sliding of plate 5 relative to supporting surface 41. Since plate 5 is inextendible in both lateral and longitudinal directions thereof and due to the interconnection between plate 5 and each of the carpet sections 27 and 30, the seam will remain intact throughout the stretching operation. In fact, the seam will actually experience little or no tension as the tension created by the power stretching operation will bypass the seam through plate 5. This will greatly minimize any potential failure of the seam and enhances seam tightness. In addition, the nominal thickness of plate 5 assures that no high spots are formed.

From the above description, it should be readily apparent that an efficient and effective seaming arrangement is provided by the present invention which will eliminate seam failure problems, particularly with power stretched carpet installations. This seaming arrangement can also be effectively used to replace entirely glued-down carpet installations so as to avoid the problems and costs associated with removing the old glued-down carpets. Actually, these removal costs currently range approximately $1.50–$2.00 per square yard and therefore a significant savings can be achieved.

Although described with reference to the preferred embodiment depicted in the drawings, it should be readily understood that various changes and/or modifications may be made to the invention without departing from the spirit thereof. In general, the invention is only intended to be limited by the scope of the following claims.

I claim:

1. A carpet seaming apparatus comprising:

an elongated plate having an upper surface and a lower surface, said lower surface being substantially smooth and free of an additional layer and said upper surface being divided into multiple transversely spaced and longitudinally extending zones including first and second edge zones which are laterally spaced by a central zone, said plate being inextendible in both longitudinal and lateral directions;

a plurality of sharp projections extending upwardly at spaced locations from said first and second edge zones; and an adhesive layer positioned within said central zone and extending substantially entirely the length of said elongated plate, said plate being adapted to be slidably positioned upon a supporting surface and interconnected to carpet sections to be seamed by positioning said plate below said carpet sections with terminal edge portions of said carpet sections being engaged with a respective set of said projections and abutting in said central zone whereby said carpet sections can be simultaneously stretched with said plate sliding relative to the supporting surface.

2. The carpet seaming apparatus according to claim 1, wherein said projections are located solely in said first and second edge zones.

3. The carpet seaming apparatus according to claim 2, wherein said adhesive layer is located solely in said central zone and.

4. The carpet seaming apparatus according to claim 1, wherein said plate is formed of metal and said projections are constituted by cut portions of said plate which are bent upwardly above said upper surface.

5. The carpet seaming apparatus according to claim 4, wherein said projections are angled toward said central zone.

6. The carpet seaming apparatus according to claim 4, wherein said plate is formed of galvanized sheet metal of approximately 26 gauge.

7. The carpet seaming apparatus according to claim 1, wherein said adhesive layer comprises a double-sided adhesive tape having a lower side adhered to said central zone and an upper side adapted to be adhesively secured to the carpet sections.

8. The carpet seaming apparatus according to claim 7, further comprising a protective, peelable cover positioned atop said adhesive tape.

9. A method of seaming two carpet sections comprising:

arranging edge portions of the carpet sections juxtaposed one another upon a support surface;

slidably positioning an elongated, inextendible plate, having a substantially smooth lower surface that is not provided with an additional layer, an upper surface provided with first and second longitudinally extending edge zones having plural sharp, upstanding projections and a central, adhesive containing zone extending substantially entirely the length of said elongated plate, upon the support surface the lower surface of said plate directly contacting the support surface below the edge portions of said carpet sections;

interengaging the edge portion of one of the carpet sections with the projections provided in said first edge zones and interengaging the edge portion of the other of the carpet sections with the projections provided in said second edge zone while adhesively joining the edge portions of the carpet sections together in an abutting manner in said central zone; and stretching the carpet sections by exerting a tension force on one of said carpet sections remote from said plate to cause stretching of both of said carpet sections and sliding movement of said plate relative to the support surface.

10. The method of seaming two carpet sections according to claim 9, further comprising:

providing a peelable protective cover over the adhesive in said central zone; and removing said protective cover prior to joining the edge portions of the carpet sections together.

11. The method of seaming two carpet sections according to claim 9, further comprising:

utilizing metal for said plate and forming said projections from cut portions of said plate with the projections being angled towards said central zone.

12. A carpet seaming apparatus comprising:

an elongated plate having an upper surface and a substantially smooth lower surface that is void of an additional layer, said plate being inextendible in both longitudinal and lateral directions; and means for interconnecting elongated terminal edge portions of carpet sections to be seamed to the upper surface of the plate, with the lower surface of the plate being slidably positioned upon a supporting surface directly below the carpet sections, to thereby enable the carpet sections to the simultaneously stretched with the plate sliding relative to the supporting surface, wherein the upper surface of the plate is divided into multiple transversely spaced and longitudinally extending zones including first and second edge zones which are laterally spaced by a control zone and the interconnecting means includes: a plurality of sharp projections extending upwardly at spaced locations from said first and second edge zones; and an adhesive layer positioned within said central zone and extending substantially entirely the length of said elongated plate.

13. The carpet seaming apparatus according to claim 12, wherein said projections are located solely in said first and second edge zones.

14. The carpet seaming apparatus according to claim 13, wherein said adhesive layer is located solely in said central zone.

15. The carpet seaming apparatus according to claim 12, wherein said plate is formed of metal and said projections are constituted by cut portions of said plate which are bent upwardly above said upper surface.

16. The carpet seaming apparatus according to claim 15, wherein said projections are angled toward said central zone.

17. The carpet seaming apparatus according to claim 15, wherein said plate is formed of galvanized sheet metal of approximately 26 gauge.

18. The carpet seaming apparatus according to claim 12, further comprising a protective, peelable cover positioned atop said adhesive layer.

* * * * *

UNITED STATES PATENT AND TRADEMARK OFFICE

CERTIFICATE OF CORRECTION

PATENT NO. : 5,800,664
DATED : Sept. 1, 1998
INVENTOR(S) : Covert

It is certified that error appears in the above-identified patent and that said Letters Patent is hereby corrected as shown below:

Title page, item [76] Inventor, line 2, "Mich." to --Miss.--.

Signed and Sealed this

Twenty-ninth Day of December, 1998

*Attest:*

Bruce Lehman

BRUCE LEHMAN

*Attesting Officer*

*Commissioner of Patents and Trademarks*